US010663205B2

(12) United States Patent
Brewer et al.

(10) Patent No.: US 10,663,205 B2
(45) Date of Patent: May 26, 2020

(54) ICE-MAKER WITH WEIGHT-SENSITIVE ICE BIN

(71) Applicant: Illinois Tool Works Inc., Glenview, IL (US)

(72) Inventors: Mark Edward Brewer, New Berlin, WI (US); Eric K. Larson, Cumberland, RI (US); William Dante Chatelle, Cranston, RI (US)

(73) Assignee: Illinois Tool Works Inc., Glenview, IL (US)

( * ) Notice: Subject to any disclaimer, the term of this patent is extended or adjusted under 35 U.S.C. 154(b) by 157 days.

(21) Appl. No.: 15/756,382

(22) PCT Filed: Aug. 9, 2016

(86) PCT No.: PCT/US2016/046164

§ 371 (c)(1),
(2) Date: Feb. 28, 2018

(87) PCT Pub. No.: WO2017/039978

PCT Pub. Date: Mar. 9, 2017

(65) Prior Publication Data

US 2018/0245833 A1 Aug. 30, 2018

Related U.S. Application Data

(60) Provisional application No. 62/212,741, filed on Sep. 1, 2015.

(51) Int. Cl.

| | |
|---|---|
| ***F25C 5/187*** | (2018.01) |
| ***F25C 5/20*** | (2018.01) |
| ***F25C 1/22*** | (2018.01) |

(52) U.S. Cl.
CPC ..... *F25C 5/187* (2013.01); *F25C 1/22* (2013.01); *F25C 5/24* (2018.01); *F25C 2300/00* (2013.01);
(Continued)

(58) Field of Classification Search
CPC ... F25D 1/22; F25D 5/187; F25D 5/24; F25D 2300/00; F25D 2400/04; F25D 2400/10;
(Continued)

(56) References Cited

U.S. PATENT DOCUMENTS 4,738,325 A * 4/1988 Bullivant ..... G01G 3/14 177/210 EM
2008/0157644 A1 7/2008 Lee et al.
(Continued)

FOREIGN PATENT DOCUMENTS

JP 2003279216 A 10/2003

OTHER PUBLICATIONS

International Search Report for Application PCT/US2016/046164; dated Oct. 26, 2016.

*Primary Examiner* — Marc E Norman
(74) *Attorney, Agent, or Firm* — Boyle Fredrickson, S.C.

(57) ABSTRACT

An ice-maker (12) provides a weight-sensing ice bin (16) that provides multiple levels of ice measurement thereby allowing improved control strategies that reduce ice making or ice making rate in accordance with anticipated ice usage to eliminate energy costs and the need to discard stale ice cubes. The weight sensor may be an induction sensor where the coil also serves a heating function for defrosting.

18 Claims, 3 Drawing Sheets

(52) U.S. Cl.
CPC ..... *F25C 2400/04* (2013.01); *F25C 2400/10* (2013.01); *F25C 2600/04* (2013.01); *F25C 2700/02* (2013.01)

(58) Field of Classification Search
CPC .... F25D 2600/04; F25D 2700/02; F25C 1/22; F25C 5/187; F25C 5/24; F25C 2300/00; F25C 2400/04; F25C 2400/10; F25C 2600/04; F25C 2700/02
See application file for complete search history.

(56) References Cited

U.S. PATENT DOCUMENTS

2009/0314016 A1 12/2009 Ashrafzadeh et al.
2015/0059394 A1* 3/2015 Gomes ..... F25C 5/06 62/340

* cited by examiner

ICE-MAKER WITH WEIGHT-SENSITIVE ICE BIN

CROSS REFERENCE TO RELATED APPLICATIONS

This application claims the benefit of U.S. provisional application 62/212,741 filed Sep. 1, 2015, and hereby incorporated by reference in its entirety.

FIELD OF THE INVENTION

The present invention relates to ice making machines for home refrigerators and the like and specifically to an ice-making machine providing improved measurement of stored ice.

BACKGROUND OF THE INVENTION

Household refrigerators commonly include automatic ice-makers located in the freezer compartment. A typical ice-maker provides an ice cube mold positioned to receive water from an electric valve that may open for a predetermined time to fill the mold. The water is allowed to cool until a temperature sensor attached to the ice cube mold detects a predetermined low-temperature point where ice formation is ensured. At this point, the ice is harvested from the ice cube mold by a drive mechanism and released into an ice bin positioned beneath the ice mold.

The ice harvesting mechanism may, in one example, distort the ice cube mold to remove the "cubes" by twisting one end of the flexible ice tray when the other end abuts a stop. After a brief period of time during which the motor twisting the ice mold may stall and during which the ice cubes may be ejected from the tray, the motor is reversed in direction to bring the ice tray back to its fill position for refilling. Alternatively, the cubes may be ejected by rotating an ejector comb that sweeps through the tray to remove the cubes. At the end of the ejection cycle, the tray or comb returns to a home position as may be detected by a limit switch.

An ice sensor may be provided to determine when the ice-receiving bin is full. One sensor design periodically lowers a bail arm into the ice bin after each harvesting to gauge the amount of ice in the bin. If the bail arm's descent, as determined by a limit switch, is limited by ice filling the bin to a predetermined height, harvesting is suspended.

Typical ice-makers operate to completely fill the ice bin so that ice can be available on demand by the consumer from reserves in the ice bin without concern for the relatively slow rate of ice production. The ice bin is sized to accommodate anticipated times of high ice usage; however, consumers rarely require a full bin of ice at one time, instead using small amounts of ice periodically over the space of days. With this usage pattern, a control strategy of maintaining the bin in a full configuration can lead to excess energy consumption and the creation of "stale" ice, being ice that has resided in the refrigerator for an a sufficient period of time to begin to absorb refrigerator odors that can be imparted into a drink when that ice is used.

SUMMARY OF THE INVENTION

The present invention provides an ice-maker employing an electronic scale to sense not only that the bin is full or empty but a range of different amounts of filling of the bin. This additional information allows a more sophisticated strategy of controlling the ice-maker including limiting the amount of ice in the bin to lower amounts or changing the rate of ice production to minimize stale ice.

In one embodiment, the invention employs a variable inductance scale element highly resistant to freezing and wherein the coil of the inductor can be used as a heater to defrost the induction mechanism. Other sensor systems are also contemplated.

More specifically, in one embodiment, the invention provides an ice-maker positionable within a refrigerator to make and eject ice cubes according to a control signal and an ice bin for receiving the ice cubes therein. An ice bin holder supports the ice bin and has a weight sensor providing a multi-value weight measurement signal indicating at least four different weights on the ice bin holder indicating respectively: a missing ice bin, a present ice bin having less than a first non-full level of ice, a present ice bin having a first non-full level of ice, and a present ice bin full of ice. A controller receives the multi-value weight measurement signal from the ice bin holder to respond to each of the four different weight signals in providing the control signal to the ice-maker.

It is thus a feature of at least one embodiment of the invention to provide improved energy savings in an ice-maker by permitting improved control of the amount and/or rate of ice production.

The controller may respond to the multi-value weight measurement signal indicating the presence of the ice bin having a first non-full level of ice by providing a control signal to decrease a rate of ice production in comparison to a rate of ice production when the multi-value weight measurement signal indicates the presence of the ice bin having less than the first non-full level of ice in the ice-bin.

It is thus a feature of at least one embodiment of the invention to control a rate of ice production as a function of the filling of the ice bin to decrease energy usage in the form of heat being removed from the ice cubes during freezing by the refrigerator and to increase the availability of a top level of fresh ice.

The controller may respond to the multi-value weight measurement signal indicating the presence of the ice bin having a first non-full level of ice by providing a control signal to stop ice production.

It is thus a feature of at least one embodiment of the invention to permit adjustment of the amount of filling of the ice bin to multiple different setpoint levels tailored to the needs of different consumers.

The controller may respond to the multi-value weight measurement signal indicating a missing ice bin by providing a control signal to the ice-maker to stop ice making.

It is thus a feature of at least one embodiment of the invention permit the same weighing mechanism to detect a missing bin avoiding the cost of additional sensors.

The controller may further respond to the multi-value weight measurement signal indicating a present full ice bin by providing a control signal to the ice-maker to stop ice making.

It is thus a feature of at least one embodiment of the invention to eliminate the need for a mechanical bail arm or the like to prevent ice bin overflow.

The ice-maker system may receive input indicating anticipated low ice consumption and responds to this input and the multi-value weight measurement signal indicating the presence of the ice bin having a first non-full level of ice by providing a control signal to stop the ice-maker or to slow the ice-maker.

It is thus a feature of at least one embodiment of the invention to permit adjustment of the amount of filling of the ice bin to individual circumstances and needs.

The input may be a switch setting by a consumer.

It is thus a feature of at least one embodiment of the invention to permit the consumer to select ice level amounts according to his or her needs.

Alternatively, the input may be a historical measurement of ice consumption revealed by the weight sensor.

It is thus a feature of at least one embodiment of the invention permit the weight sensor to collect data about individual usage patterns to automatically minimize wasted ice and energy.

The input may be a function of the day of the week tracked by the controller.

It is thus a feature of at least one embodiment of the invention to make use of the controller to track days of the week such as can be highly correlated ice usage thereby providing improved anticipation of ice usage for reduced energy and ice waste.

The controller may provide a signal to the consumer indicating stale ice when the multi-value weight measurement signal indicates a present bin having at least a first non-full level of ice for a predetermined period of time after a last multi-value weight measurement signal indicating a present bin having less than a first non-full level of ice.

It is thus a feature of at least one embodiment of the invention to permit improved information about ice usage to be used to indicate to the consumer that the ice has become stale. This is enabled by the ability to distinguish between an empty ice bin and a less than full ice bin.

The controller may monitor the multi-value weight signal before and after an ejection of ice cubes by the ice-maker to determine whether a weight change was recognized by the weight sensor and if not to activate a defrosting mechanism. Alternatively or in addition, error may result in an error notification to the consumer and/or a deactivation of the ice-maker.

It is thus a feature of at least one embodiment of the invention to self diagnose failure in the weighing mechanism by examining changes in weight that should accompany the introduction of a new load of ice into the bin and to attempt defrosting of the weight mechanism.

The weight sensor may include a spring system supporting the ice bin and a variable inductor providing a range of inductance measurements with deflection of the spring system according to the weight of the ice bin.

It is thus a feature of at least one embodiment of the invention to provide a robust weight measuring system adapted for operation in the environment of the freezer where moisture and frost build up are present.

The defrost mechanism used when the weighing mechanism must be defrosted may be an electrical coil providing a variable inductor of the weight sensor.

It is thus a feature of at least one embodiment of the invention to employ the same structure needed for weighing to provide defrosting of the weight sensor as needed.

Alternatively the weight sensor may be a spring system supporting the ice bin and a Hall Effect sensor system providing a range of output values with deflection of the spring system according to the weight of the ice bin. The Hall Effect system may include multiple Hall Effect sensors triggered by a magnet movable with respect to the Hall Effect sensors under deflection of the spring system.

It is thus a feature of at least one embodiment of the invention to provide a compact and robust weight sensing mechanism permitting clearances that are highly resistant to frost build up.

Other features and advantages of the invention will become apparent to those skilled in the art upon review of the following detailed description, claims and drawings in which like numerals are used to designate like features.

Figure 1:
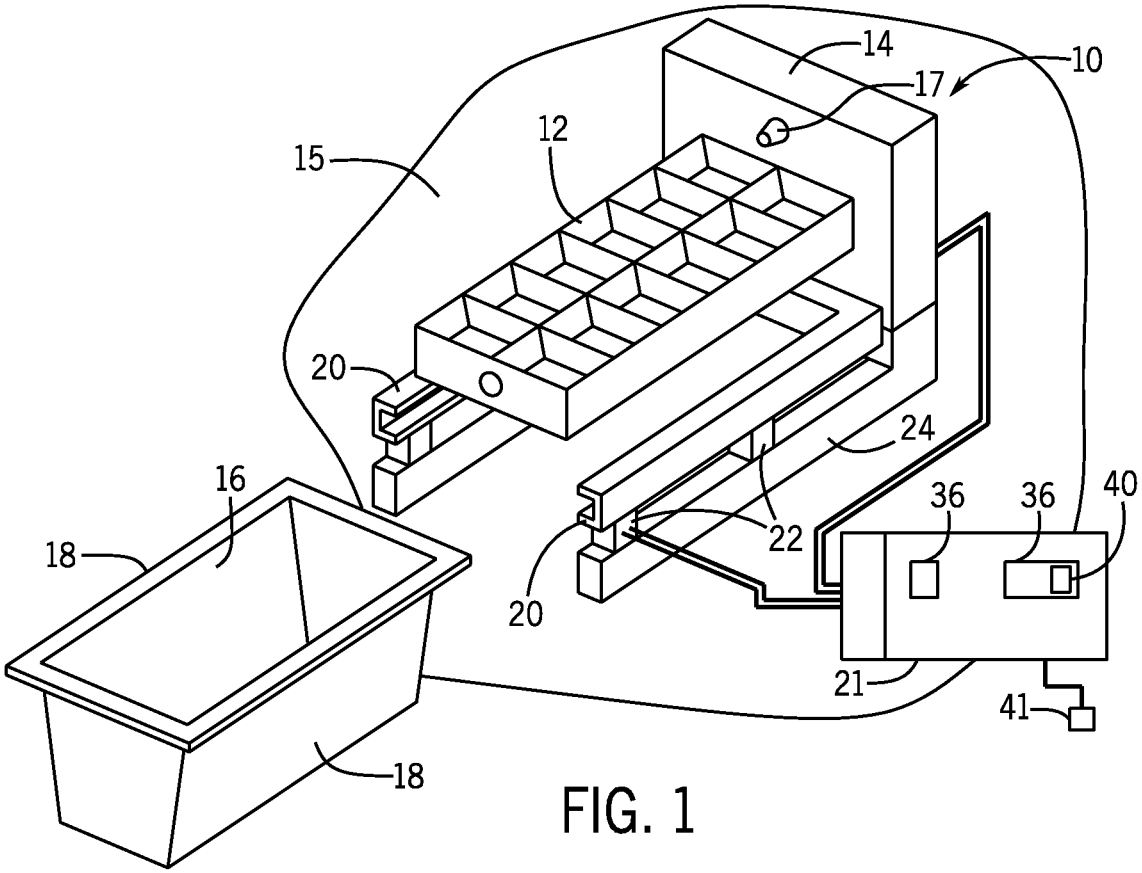
FIG. 1 is a perspective view of an ice-maker constructed according to one embodiment of the present invention showing an ice bin support communicating with at least one force-sensing element and with an ice-maker controller.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENTS

Referring now to FIG. 1, an ice-maker 10 may include an ice mold 12 for receiving water and molding it into frozen ice cubes (not shown) of arbitrary shape. The ice mold 12 may be positioned adjacent to ice harvest drive mechanism 14 operating to remove cubes from the ice mold 12 when they are frozen, for example, by inversion and distortion of the ice mold 12 or use of an ejector comb (not shown). As such, the ice harvest drive mechanism 14 may include a motor for rotating the ice mold 12 and ejecting the ice, and a valve system for dispensing water, for example, through a nozzle 17 into the ice mold 12, all under electronic control. The ice harvest drive mechanism 14 may be mounted against a wall 15 of the refrigerator to be held stationary within a refrigerated cavity.

The ice mold 12 is normally positioned above an ice storage bin 16 for receiving cubes therein when the latter are ejected from the ice mold 12. In one embodiment, the ice bin 16 may have upper, outwardly horizontally extending flanges 18 that may be received by corresponding horizontally open channels 20 positioned beneath the ice mold 12 and extending along a path of insertion of the ice storage bin 16 into the channels 20. In this way, the ice bin 16 may slide beneath the ice mold 12 for receiving ice cubes or be removed from the channel 20 for extraction of ice cubes from the bin 16 or cleaning of the bin or the like.

The channels 20 may be supported by one or more spring-loaded elements 22 that in turn are supported on support structure 24 tied to the ice harvest drive mechanism 14 or to the wall 15 of the refrigerator. It will be understood, that when the ice bin 16 is installed in the channels 20, the weight of the ice bin 16 and its contents press down on the spring elements 22 in an amount proportional to that weight.

At least one of the spring-loaded scale elements 22 may provide a sensor to be described below which may communicate electrical sensing signals to a controller 21 also controlling the ice harvest drive mechanism 14 as will be discussed.

The controller 21 may also receive a consumer input setting through a switch element 41, for example, used to set an ice-making rate or fill level of the ice bin 16 to different rates or levels as will be discussed below. Similar controls (not shown) may be used for programming of the controller 21 by the consumer, for example, to indicate a date or time. The controller 21 also receives a signal from the ice harvest drive mechanism indicating when ice is being injected into the ice bin 16. This signal may be generated, for example, by a switch or sensor on a gear drive of the mechanism.

Figure 2:
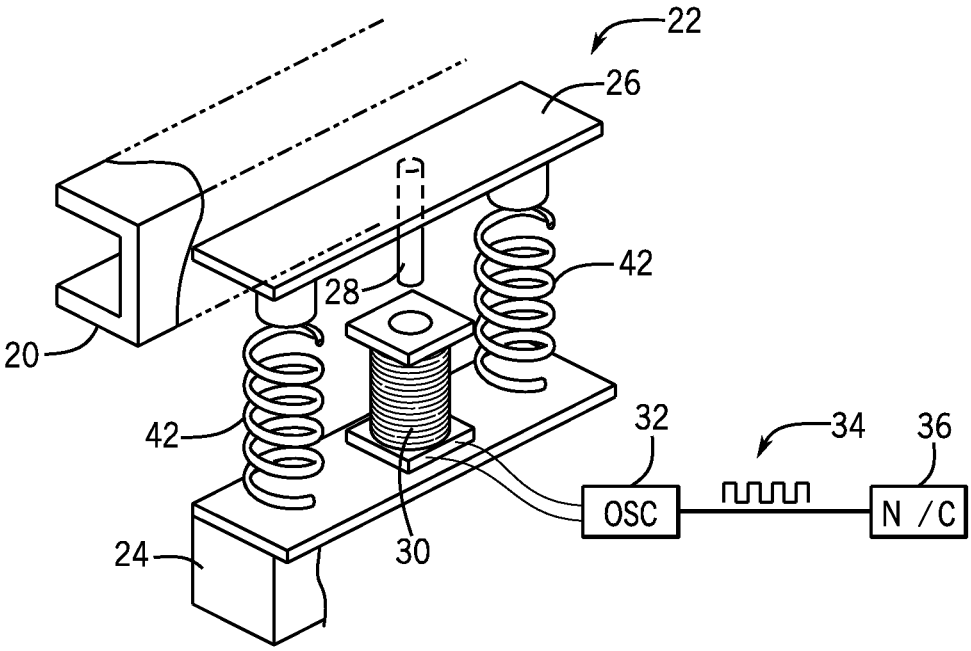
FIG. 2 is an exploded fragmentary view of a sensing element suitable for use in the ice-maker of FIG. 1 using a variable induction sensor.

Referring now also to FIG. 2, at least one of the scale elements 22 providing the electrical sensor signals to the controller 21 may present an upper scale plate 26 supporting a channel 20 on its upper surface and having an inductor core 28 extending downwardly from its lower surface. Inductor core 28 may be a soft iron, steel or a ferrite, or other similar high-permeability material. Inductor core 28 may be received within a conductive wire solenoid 30. The upper scale plate 26 is spring biased so that the upper scale plate 26 moves downward with increased weight on the channel 20 resulting in the inductor core 28 being inserted with a greater distance into the solenoid 30 thus changing the inductance of the solenoid 30.

This changing inductance of the solenoid 30 may be measured by any induction measuring technique, for example, by incorporating the inductor as part of the oscillator circuit 32 so that changes in solenoid 30 produce changes in a frequency output 34 of the oscillator circuit 32. This frequency output may be measured, for example, by a microcontroller 36 forming part of the controller 21 and communicating with a memory 38 (shown in FIG. 1) holding a stored program 40 as will be discussed below.

By measuring the frequency output of the oscillator circuit 32, the microcontroller 36 executing the program 40 may deduce the inductance of the solenoid 30 and hence the amount of insertion of core 28 into the solenoid 30. The microcontroller 36 may measure the frequency output of the oscillator circuit 32, for example, accounting for oscillator cycles for a period of time. It will be appreciated that at least four different weight ranges may be distinguished and potentially many more.

As noted, the scale plate 26 may be spring, for example, by vertically extending helical compression springs 42, for example, positioned symmetrically on opposite sides of the solenoid 30 so the amount of depression of the scale plate 26 will be proportional to the force applied to the scale plate 26 according to the spring constants of the springs 42 under Hooke's law. Generally, it will be appreciated that other spring types may be used for the function of springs 42 including other types of compression springs, leaf springs, extension springs, torsion springs, and combination thereof.

Figure 3:
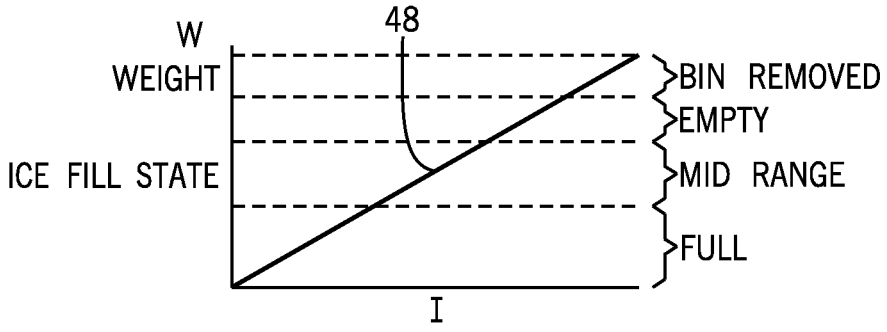
FIG. 3 is a plot of inductance versus weight used by the controller of FIG. 1 for control of the ice-maker according the weight of ice in the bin.

Referring now also to FIG. 3, it will be appreciated that the ability to measure the change of inductance of the solenoid 30 combined with a known spring constant of the springs 42 allows a measurement of inductance (I) to be translated to a weight value (W) of the bin 16 by an empirically determinable conversion function 48 with generally greater inductance corresponding to greater weight. The range of weights may be divided into different ice bin states providing distinct control actions by the controller 21. For example, the weight ranges may be divided into four weight ranges with the lightest weight measurement being equivalent to a determination that the bin 16 has been removed from the channels 20, followed by the next lightest state indicating that the bin is in place but empty or nearly empty, a next state of greater weight indicating that the bin is partially but not completely filled and a final greatest weight range indicating that the bin is full or nearly full.

Figure 5:
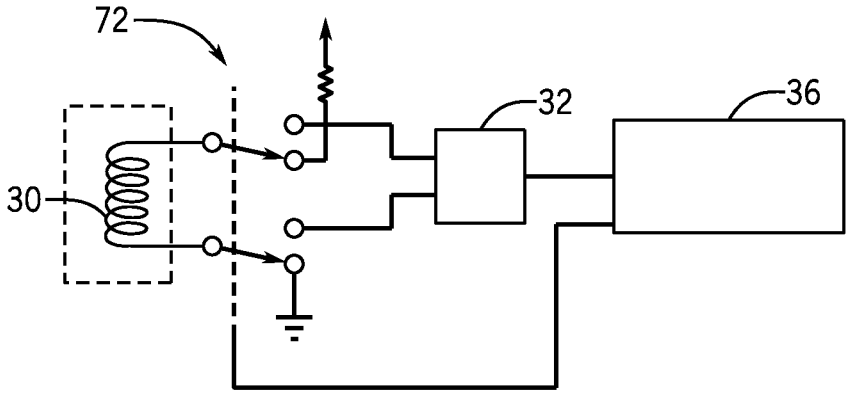
FIG. 5 is an optional defrost circuit that may be used with the sensor FIG. 2.

Referring now to FIGS. 3 and 5, the program 40 executing on the microcontroller 36 may first determine a state of filling of the bin 16 by measuring its weight as indicated by process block 50. This determination uses the function 48 (for example, approximated by a line or polynomial or stored as a lookup table) and the measured inductance described above.

At a first decision block 52 it may be determined whether the bin 16 has been removed from the channels 20 per the "bin removed" state shown in FIG. 3. This process compares the deduced weight of the bin 16 against pre-established ranges described with respect to FIG. 3. If so, at process block 54, ice making is stopped so that ice is not discharged or dumped from the ice mold 12 without the bin 16 being in place. It will be appreciated that an alternative sensor such as a mechanical switch for optical interrupt may be used to sense the presence of the bin 16. After process block 54, the program 40 loops back to process block 50 so that ice level in the bin can again be established.

If at decision block 52 the bin 16 has not been removed, then it may be determined if the bin 16 is in the full state at decision block 56, again evaluating the ranges of FIG. 3. If so, again, ice making may be stopped to prevent overflow of the bin 16. If the bin 16 remains in the full state for a predetermined amount of time, for example, set by the consumer, an optional alert may be provided to recommend emptying the ice to obtain new fresh ice. More generally, the ability to monitor weight and an assumption that the last created ice cubes are the first removed allows the ability to determine the age of the oldest ice in the bin which can be used to trigger a staleness alert. A complete emptying of the bin may reset the staleness timer. A removal of the bin that returns the bin in a non-empty state may be ignored and the nonempty state used in determining the staleness history.

If the bin is not full at decision block 56, then at decision block 58, it may be determined whether the ice level is at a mid-height position, for example, filling half the height of the bin 16. It will be appreciated that multiple different mid-height ranges can be used in this capacity. If the ice bin is at the mid-height but not full state, the program 40 may proceed to process block 60 and ice making may be slowed or stopped. Ice making may be stopped if the consumer has opted not to completely fill the bin, for example, with the interest of preventing ice from becoming stale and conserving energy based on the consumer's ice usage. Alternatively ice making may be simply slowed reflecting lower use. Slowing ice making may be implemented by returning the ice mold 12 to its upright position but not immediately filling the ice mold 12 through nozzle 17. This delay prevents the ice from becoming stale in the event that little ice is used. Delaying the rate of ice making prolongs the period of time during which a top layer of ice is not stale.

It will be appreciated that improved knowledge of the consumption of ice possible with this system allows the system to better predict the amount of ice needed by consumer. Accordingly the program in some options may provide a tracking of ice usage (by weight measurement) as a function of day of the week and in this way tailor the amount of ice produced better to the individual's consumption patterns. For example, ice production may be slowed or the bin fill height reduced when it is predicted that less ice will be used and ice production rate maximized and the fill height maximized when it is anticipated that greater amounts of ice will be needed. The ability to discern multiple heights of ice also allows the consumer to enter ice production preferences in terms of how much the ice bin 16 should be filled and how much ice should be produced, for example, on a daily basis, roughly analogous to a setting of a setback thermometer, programming an anticipated ice usage for each day of the week and thereby preventing stale ice from accumulating and energy being wasted.

If the ice is not at the mid-height as determined by decision block 58, the program 40 proceeds to decision block 62 and the ice level measured at process block 50 is checked to see if the amount of ice is low, for example, per the ranges as shown in FIG. 3. If so, the program may proceed to process block 64 and ice production may be increased in speed within the parameters established above indicating consumer preference.

Operating in parallel with decision blocks 52, 56, 58, and 62 but shown serially for convenience of illustration is a decision block 66 triggered only when the ice mold 12 is dumped, meaning that the ice mold 12 has been inverted to discharge ice cubes into the bin 16 as signaled from the ice harvest drive mechanism 14 to the controller 21. In that case, program 40 may proceed to decision block 68 and the signal from the oscillator circuit 32 may be interrogated to determine if there has been a weight change in the proper direction (increase) by a proper increment (being conservatively below the expected amount of ice to be released from the ice mold 12). If so the program proceeds back to process block 50, but if not a heat coil cycle, indicated by process block 70, may be implemented under the assumption that scale element 22 has frozen or failed in some way.

Referring to FIG. 9, in one embodiment, during the heat coil cycle, the oscillator circuit 32 may be disconnected from the solenoid 30, for example, by a relay contact 72 operated by the microcontroller 36 and a direct-current of predetermined amount of substantially higher amperage than that provided by the oscillator circuit 32 may be run through the solenoid 30 to increase its temperature by an amount expected to defrost any cumulative frost on the solenoid 30. At the conclusion of the heat cycle, the weight of the ice bin 16 is again interrogated at process block 74 and if proper weight change is registered, the program 40 proceeds back to process block 50. If the proper weight change is not indicated, an error condition is indicated per process block 76 indicating a malfunction of the ice-maker. This error condition may result in an output to the consumer (for example, a tone or light) and a ceasing of operation of the ice harvest drive mechanism 14 under the assumption that overflow cannot be determined.

Figure 6:
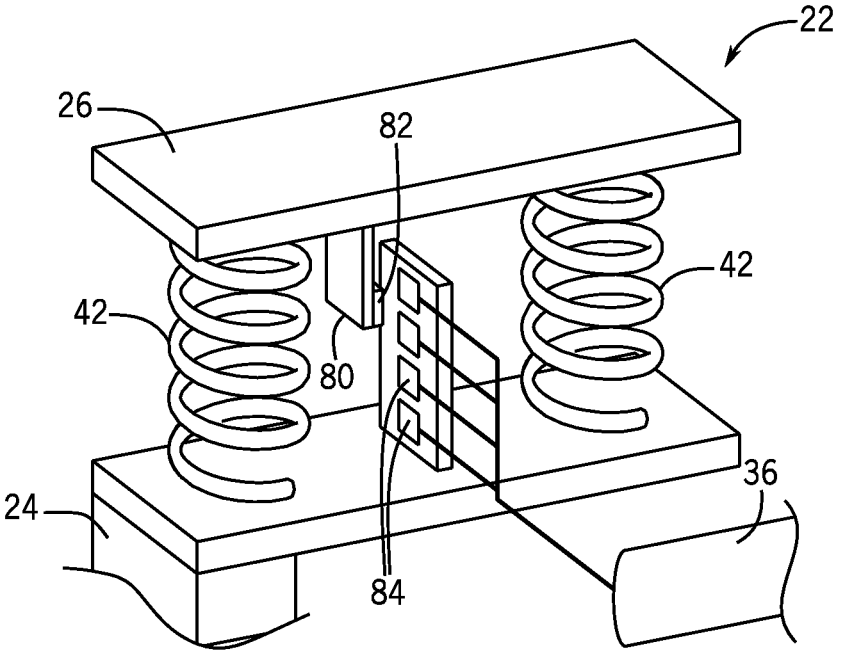
FIG. 6 is a figure similar to FIG. 2 showing an alternative Hall sensor technology.
Figure 4:
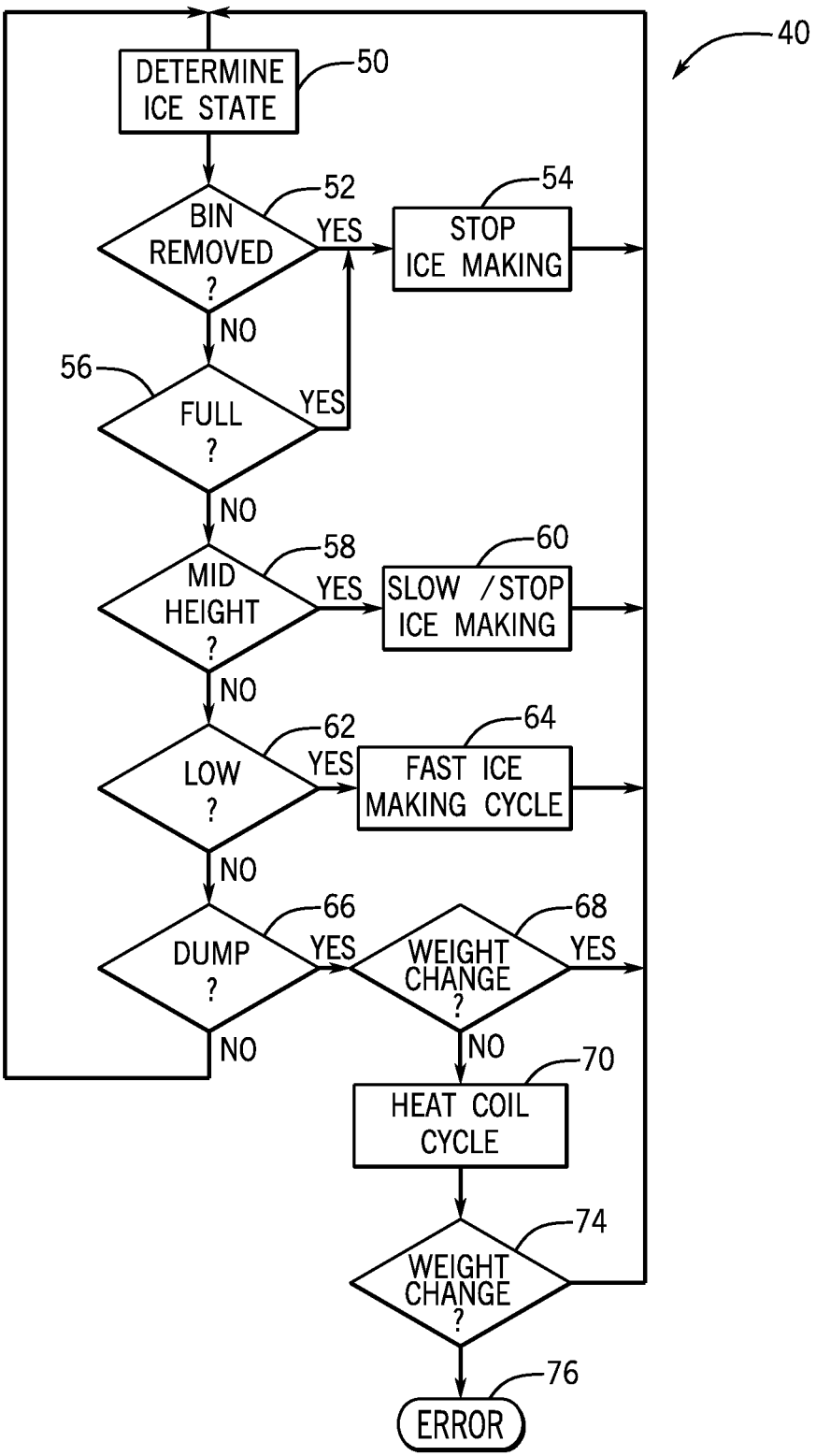
FIG. 4 is a flowchart of a program executed by the controller of FIG. 1 in controlling the ice-maker.

Referring now to FIG. 6, in an alternative design, the spring-loaded scale element 22 may provide a scale plate 26 having a permanent magnet 80 (e.g., a ceramic magnet that is resistant to corrosion) suspended on a downwardly extending arm 82 from a lower surface of the scale plate 26 in place of the inductive core 28. The magnet 80 may pass along multiple vertically separated Hall effect sensors 84 (for example, attached to a circuit card) each providing signals to the microcontroller 36 indicating the height of the magnet 80 with respect to the Hall effect sensors 84, the latter position stationary with respect to a wall 15 of the refrigerator. The number of Hall Effect sensors 84 may be such as to provide an arbitrary number of ranges of the type shown in FIG. 3 substituted for the inductance value described above. It will be appreciated that individual Hall sensors may provide for multiple height measurements by measuring the intensity of the magnetic signal. The Hall Effect sensor 84 and the circuit card may be coated with a protective material through which the magnetic field may pass.

It will be appreciated that other techniques for weight sensing may be employed including load cells, spring-mounted platforms sensed by optical systems, linear variable differential transformers, ultrasound, reed switches and magnets and the like. In one embodiment, variation in the capacitance of two or more plates distributed between the bin and a stationary structure may be determined to measure the change of position of the bin with the addition or removal of weight. The optical sensor may include a reflection type sensor or a sensor using a blocking and unblocking structure that moves with relative movement of the bin. One type of optical sensor contemplated measures the change of light intensity between a light emitter and a light detector separated between the bin and stationary structure or measuring the separation of a reflector on one of the bin and stationary structure. The magnets may be used with flux-directing metal elements to focus the flux.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

What is claimed is:

1. An ice-maker system comprising:

an ice-maker positionable within a refrigerator to make and eject ice cubes according to a control signal;

an ice bin for receiving the ice cubes therein;

an ice bin holder supporting the ice bin and having a weight sensor providing a multi-value weight measurement signal indicating at least four different weights on the ice bin holder indicating, respectively, a missing ice bin condition, a present ice bin having less than a first non-full level of ice condition, a present ice bin having a first non-full level of ice condition, and a present ice bin full of ice condition; and a controller receiving the multi-value weight measurement signal from the ice bin holder to respond to each of the at least four different weights in providing the control signal to the ice-maker, with the control signal providing at least:

a stop command to stop making ice during either (i) the missing ice bin condition or (ii) the present ice bin full of ice condition;

a first ice making rate command to make ice at a first rate during the present ice bin having the less than the first non-full level of ice condition; and a second ice making rate command to make ice at a second rate during the present ice bin having the first non-full level of ice condition.

2. The ice-maker system of claim 1 wherein the controller provides a signal to a user indicating stale ice when the multi-value weight measurement signal indicates a present bin having at least a first non-full level of ice for a predetermined period of time after a last multi-value weight measurement signal indicating a present bin having less than a first non-full level of ice.

3. The ice-maker system of claim 1 wherein the weight sensor includes a spring system supporting the ice bin and a variable inductor providing a range of inductance measurements with deflection of the spring system according to the weight of the ice bin.

4. The ice-maker system of claim 1 wherein the weight sensor is a spring system supporting the ice bin and a Hall Effect sensor system providing a range of output values with deflection of the spring system according to the weight of the ice bin.

5. The ice-maker system of claim 4 wherein the Hall Effect system is multiple Hall Effect sensors triggered by a magnet movable with respect to the Hall Effect sensors under deflection of the spring system.

6. An ice-maker system comprising:

an ice-maker positionable within a refrigerator to make and eject ice cubes according to a control signal;

an ice bin for receiving the ice cubes therein;

an ice bin holder supporting the ice bin and having a weight sensor providing a multi-value weight measurement signal indicating at least four different weights on the ice bin holder indicating, respectively, a missing ice bin, a present ice bin having less than a first non-full level of ice, a present ice bin having a first non-full level of ice, and a present ice bin full of ice;

a controller receiving the multi-value weight measurement signal from the ice bin holder to respond to each of the at least four different weights in providing the control signal to the ice-maker; and wherein the controller further responds to the multi-value weight measurement signal indicating a presence of the ice bin having a first non-full level of ice by providing a control signal to decrease a rate of ice production in comparison to a rate of ice production when the multi-value weight measurement signal indicates the presence of the ice bin having less than the first non-full level of ice.

7. The ice-maker system of claim 6 wherein the controller provides a control signal reducing a nonzero rate of ice making as the weight increases between the weights of a present ice bin having less than a first non-full level of ice and a present ice bin having a first non-full level of ice.

8. The ice-maker system of claim 6 wherein the controller further responds to the multi-value weight measurement signal indicating a presence of the ice bin having a first non-full level of ice by providing a control signal to stop ice production.

9. The ice-maker system of claim 8 wherein the controller responds to the multi-value weight measurement signal indicating a missing ice bin by providing a control signal to the ice-maker to stop ice making.

10. The ice-maker system of claim 9 wherein the controller responds to the multi-value weight measurement signal indicating a present full ice bin by providing a control signal to the ice-maker to stop ice making.

11. An ice-maker system comprising:

an ice-maker positionable within a refrigerator to make and eject ice cubes according to a control signal;

an ice bin for receiving the ice cubes therein;

an ice bin holder supporting the ice bin and having a weight sensor providing a multi-value weight measurement signal indicating at least four different weights on the ice bin holder indicating, respectively, a missing ice bin, a present ice bin having less than a first non-full level of ice, a present ice bin having a first non-full level of ice, and a present ice bin full of ice;

a controller receiving the multi-value weight measurement signal from the ice bin holder to respond to each of the at least four different weights in providing the control signal to the ice-maker; and wherein the controller further receives input indicating anticipated low ice consumption and responds to this input and the multi-value weight measurement signal indicating a presence of the ice bin having a first non-full level of ice by providing a control signal to stop the ice-maker.

12. An ice-maker system comprising:

an ice-maker positionable within a refrigerator to make and eject ice cubes according to a control signal;

an ice bin for receiving the ice cubes therein;

an ice bin holder supporting the ice bin and having a weight sensor providing a multi-value weight measurement signal indicating at least four different weights on the ice bin holder indicating, respectively, a missing ice bin, a present ice bin having less than a first non-full level of ice, a present ice bin having a first non-full level of ice, and a present ice bin full of ice;

a controller receiving the multi-value weight measurement signal from the ice bin holder to respond to each of the at least four different weights in providing the control signal to the ice-maker; and wherein the controller further receives input indicating anticipated low ice consumption and responds to the multi-value weight measurement signal indicating a presence of the ice bin having a first non-full level of ice by providing a control signal to slow but not stop the ice-maker.

13. The ice-maker system of claim 12 wherein the input is a switch setting by a consumer.

14. The ice-maker system of claim 12 wherein the input is a historical measurement of ice consumption revealed by the weight sensor.

15. The ice-maker system of claim 14, wherein the input is a function of a day of a week tracked by the controller.

16. An ice-maker system comprising:

an ice-maker positionable within a refrigerator to make and eject ice cubes according to a control signal;

an ice bin for receiving the ice cubes therein;

an ice bin holder supporting the ice bin and having a weight sensor providing a multi-value weight measurement signal indicating at least four different weights on the ice bin holder indicating, respectively, a missing ice bin, a present ice bin having less than a first non-full level of ice, a present ice bin having a first non-full level of ice, and a present ice bin full of ice;

a controller receiving the multi-value weight measurement signal from the ice bin holder to respond to each of the at least four different weights in providing the control signal to the ice-maker; and wherein the controller monitors the multi-value weight signal before and after an ejection of ice cubes by the ice-maker to determine whether a weight change was recognized by the weight sensor and if not activates a defrosting mechanism.

17. The ice-maker system of claim 16 wherein the weight sensor includes a spring system supporting the ice bin and a variable inductor providing a range of inductance measurements with deflection of the spring system according to the weight of the ice bin and wherein the defrosting mechanism is an application of a heating electrical current to the variable inductor to generate heat therein.

18. An ice-maker system comprising:

an ice-maker positionable within a refrigerator to make and eject ice cubes according to a control signal;

an ice bin for receiving the ice cubes therein;

an ice bin holder supporting the ice bin and having a weight sensor providing a multi-value weight measurement signal indicating at least four different weights on the ice bin holder indicating, respectively, a missing ice bin, a present ice bin having less than a first non-full level of ice, a present ice bin having a first non-full level of ice, and a present ice bin full of ice;

a controller receiving the multi-value weight measurement signal from the ice bin holder to respond to each of the at least four different weights in providing the control signal to the ice-maker; and wherein the controller monitors the multi-value weight signal before and after an ejection of ice cubes by the ice-maker to determine whether a weight change was recognized by the weight sensor and if not provides an error notification to a user and deactivates the ice-maker.

* * * * *